United States Patent [19]

Chang

[11] Patent Number: 5,061,324

[45] Date of Patent: Oct. 29, 1991

[54] THERMOMECHANICAL PROCESSING FOR FATIGUE-RESISTANT NICKEL BASED SUPERALLOYS

[75] Inventor: Keh-Minn Chang, Schenectady, N.Y.

[73] Assignee: General Electric Company, Schenectady, N.Y.

[21] Appl. No.: 503,007

[22] Filed: Apr. 2, 1990

[51] Int. Cl.[5] ..... C22F 1/10

[52] U.S. Cl. ..... 148/11.5 N; 148/11.5 P; 148/12.7 N

[58] Field of Search ..... 148/11.5 N, 11.5 P, 148/12.7 N

[56] References Cited

U.S. PATENT DOCUMENTS 4,814,023 3/1989 Chang ..... 148/11.5 N

*Primary Examiner*—Melvyn J. Andrews

*Attorney, Agent, or Firm*—James E. McGinness; James C. Davis, Jr.; James Magee, Jr.

[57] ABSTRACT

Thermomechanical processing treatments for powder compacts formed from powdered superalloy compositions having a volume fraction of gamma prime greater than 35 percent are disclosed. Isothermal forging within critical ranges of strain rate and temperature is followed by supersolvus annealing and slow cooling treatments. An enlarged grain structure about 50 to 60 microns in size is produced that improves resistance to fatigue crack propagation in the superalloys.

10 Claims, 8 Drawing Sheets

THERMOMECHANICAL PROCESSING FOR FATIGUE-RESISTANT NICKEL BASED SUPERALLOYS

CROSS REFERENCE TO RELATED APPLICATION

The subject application relates to copending application Ser. No. 502,951 filed Apr. 2, 1990.

BACKGROUND OF THE INVENTION

This invention relates to a method including thermomechanical processes for forming compacts of powdered superalloy compositions to improve resistance to time-dependant fatigue crack propagation.

It is well known that nickel based superalloys are extensively employed in high performance environments. Such alloys have been used extensively in jet engines and in gas turbines where they must retain high strength and other desirable physical properties at elevated temperatures of 540° C. or more.

It is also well known that in part the desirable combination of properties of such alloys at high temperatures are at least in part due to the presence of a precipitate which has been designated as a gamma prime precipitate. More detailed characteristics of the phase chemistry of gamma prime are given in "Phase Chemistries in Precipitation strengthening Superalloy" by E.L. Hall, Y.M. Kouh, and K.M. Chang [Proceedings of 41st. Annual Meeting of Electron Microscopy Society of America, August 1983 (p. 248)].

A problem which has been recognized with many nickel based superalloys is that they are subject to formation of cracks either in fabrication or in use, and that the cracks can initiate or propagate while under stress as during use of the alloys in such structures as gas turbines and jet engines. The propagation or enlargement of cracks can lead to part fracture or other failure.

Fatigue is a process of progressive localized permanent structural change occurring in a material subjected to fluctuating stresses and strains. It is well known that fatigue can cause failure of a material at stresses well below the stress the material is capable of withstanding under static load applications. What has been poorly understood until studies were conducted was that the formation and the propagation of cracks in structures formed from superalloys is not a monolithic phenomena in which all cracks are formed and propagated by the same mechanism, at the same rate, and according to the same criteria. The complexity of crack generation and propagation, and the interdependence of such propagation with the manner in which stress is applied is a subject on which important information has been gathered.

The period during which stress is applied to a member to develop or propagate a crack, the intensity of the stress applied, the rate of application and of removal of stress to and from the member and the schedule of this application was not well understood in the industry until a study was conducted under contract to the National Aeronautics and Space Administration. This study is reported in a technical report identified as NASA CR-165123 issued from the National Aeronautics and Space Administration in August 1980, identified as "Evaluation of the Cyclic Behavior of Aircraft Turbine Disk Alloys" Part II, Final Report, by B.A. Cowles, J.R. Warren and F.K. Hauke, and prepared for the National Aeronautics and Space Administration, NASA Lewis Research Center, Contract NAS3-21379.

A principal unique finding of the NASA sponsored study was that the rate of fatigue crack propagation was not uniform for all stresses applied nor to all manners of applying stress. More importantly, it was found that fatigue crack propagation actually varied with the frequency of the application of stress to the member where the stress was applied in a manner to enlarge the crack. More surprising still, was the finding from the NASA sponsored study that the application of stress at lower frequencies rather than at the higher frequencies previously employed in studies, actually increased the rate of crack propagation. In other words, the NASA study revealed that there was a time dependence in fatigue crack propagation. Further, the time dependence of fatigue crack propagation was found to depend not on frequency alone but on the time during which the member was held under stress for a so-called hold-time.

The most undesirable time-dependent crack-growth behavior has been found to occur when a hold time is superimposed on a sine wave variation in stress. In such a case, a test sample may be subjected to stress in a sine wave pattern, but when the sample is at maximum stress, the stress is held constant for a hold-time. When the hold-time is completed the sine wave application of stress is resumed. According to this hold-time pattern, the stress is held for a designated hold-time each time the stress reaches a maximum in following the normal sine curve. This hold-time pattern of application of stress is a separate criteria for studying crack growth. This type of hold-time pattern was used in the NASA study referred to above.

Crack growth, i.e., the crack propagation rate, in high-strength alloy bodies is known to depend upon the applied stress ($\sigma$) as well as the crack length (a). These two factors are combined by fracture mechanics to form one single crack growth driving force; namely, stress intensity K, which is proportional to $\sigma\sqrt{a}$. Under the fatigue condition, the stress intensity in a fatigue cycle represents the maximum variation of cyclic stress intensity ($\Delta K$), i.e., the difference between Kmax and $K_{min}$. At moderate temperatures, crack growth is determined primarily by the Cyclic stress intensity ($\Delta K$) until the static fracture toughness $K_{IC}$ is reached. Crack growth rate is expressed mathematically as da/dN $(\Delta K)^n$. N represents the number of cycles and n is a constant which is between 2 and 4. The cyclic frequency and the shape of the waveform are the important parameters determining the crack growth rate. For a given cyclic stress intensity, a slower cyclic frequency can result in a faster crack growth rate. This undesirable time-dependent behavior of fatigue crack propagation can occur in most existing high strength superalloys.

It has been determined that at low temperatures the fatigue crack propagation rate depends essentially on the intensity at which stress is applied to components and parts of such structures in a cyclic fashion. As is partially explained above, the crack growth rate at elevated temperatures cannot be determined simply as a function of the applied cyclic stress intensity $\Delta K$. Rather, the fatigue frequency can also affect the propagation rate. The NASA study demonstrated that the slower the cyclic frequency, the faster the crack grows per unit cycle of applied stress. It has also been observed that faster crack propagation occurs when a hold time is applied during the fatigue cycle. Time dependence is a term which is applied to such cracking behavior at elevated temperatures where the fatigue frequency and hold time are significant parameters. The time dependence of fatigue crack propagation is thermally activated so that the sensitivity of time dependence can be significantly magnified at 760° C. as compared to 650° C.

To achieve increased engine efficiency and greater performance, constant demands are made for improvements in the strength and temperature capability of the alloys used in aircraft engines. Now, these capabilities must be coupled with low fatigue crack propagation rates and a low order of time-dependency of such rates for aircraft engine parts that are highly stressed.

Progress has been made in reducing the time dependency of fatigue crack propagation rates in nickel based superalloys U.S. Pat. No. 4,816,084 discloses a method for annealing and slow cooling superalloy compositions having a gamma prime strengthening precipitate of at least 35 percent. Test data presented in the '084 patent shows the method produces essentially time-independent fatigue crack propagation rates at 650° C. The '084 patent is incorporated by reference herein.

It is known that some of the most demanding sets of properties for superalloys are those which are needed in connection with jet engine construction. Of the sets of properties which are needed, those which are needed for the moving parts of the engine are usually greater than those needed for static parts, although the sets of needed properties are different for the different components of an engine. Because some sets of properties have not been attainable in cast alloy materials, resort is sometimes had to the preparation of parts by powder metallurgy techniques.

This invention specifically relates to thermomechanical processing of superalloy compositions produced by powder metallurgy techniques and focuses on the fatigue properties. In particular the time-dependence of crack growth is addressed. Powder metallurgy refers to the fabrication of essentially fully dense stock or parts from metal powders. Fine metal powders are produced so that either each powder particle or a mixture of powders conforms to a final alloy composition. Loose powder aggregates are mechanically consolidated to form relatively dense compacts that are sintered at a temperature that causes strengthening and growth of interparticle bonds. The intrinsic strength of superalloy powders usually necessitates hot compaction in one or two steps combining the compaction and sintering operation. The method of this invention is directed towards thermomechanical processes for forming the powder compacts.

A Thermomechanical process is disclosed in U.S. Pat. No. 3,975,219 for producing an anisotropic microstructure of elongated grains that improves stress-rupture properties in nickel based superalloys having gamma prime strengthening precipitates. In the disclosed method a superalloy composition is placed in a temporary condition of superplasticity and formed by isothermal hot deformation at a specified strain rate and temperature to produce a total deformation in excess of about 10 percent. The strain rate is about 1 per minute or less and the deformation temperature is between the gamma prime solvus and 250° C. below the gamma prime solvus. The deformed superalloy is progressively heated in a thermal gradient to produce the elongated grains. The hot end of the thermal gradient must exceed the gamma prime solvus temperature but cannot exceed the solidus temperature of the material.

It is an object of this invention to provide a thermomechanical process for forming compacts of powdered nickel based superalloys having at least about 35 percent gamma prime, to produce essentially time-independent fatigue crack propagation rates at elevated temperatures up to about 760° C.

Another object of this invention is to form the powder compacts of superalloy compositions having a volume fraction of gamma prime greater than 35 percent, to produce an isotropic microstructure of enlarged equiaxed grains of about 50 to 60 microns in the formed compact.

BRIEF DESCRIPTION OF THE DRAWINGS

The following description of the invention will be more readily understood by making reference to the drawings which.

BRIEF DESCRIPTION OF THE INVENTION

Thermomechanical processing treatments for powder compacts formed from powdered superalloy compositions having a volume fraction of gamma prime greater than 35 percent are disclosed. Isothermal forging conditions and subsequent annealing treatments are disclosed for producing an enlarged grain structure that improves resistance to fatigue crack propagation in the superalloys. This enlarged grain is about 50 to 60 microns in size, substantially equiaxed in orientation, and is herein referred to as a growth grain structure. Isothermal forging means the forging is performed with heated dies and the compact is forged at a substantially constant temperature. Isothermal forging and annealing after forging are performed within temperature ranges below and above the solvus temperature of the superalloy that is being formed.

The solvus temperature, or temperature at which the gamma prime phase is dissolved in the alloy matrix, can be determined by differential thermal analysis as described in "Using Differential Thermal Analysis To Determine Phase Change Temperatures" by J.S. Fipphem and R.B. Sparks, Metal Progress, April, 1979, page 56. A second method requires the metallographic examination of a series of samples which have been cold reduced about 30 percent and then heat treated at various temperatures around the expected phase transition temperature. At least one of these methods is conducted on samples of the superalloy before subjecting the compacts to forging.

Figure 1:
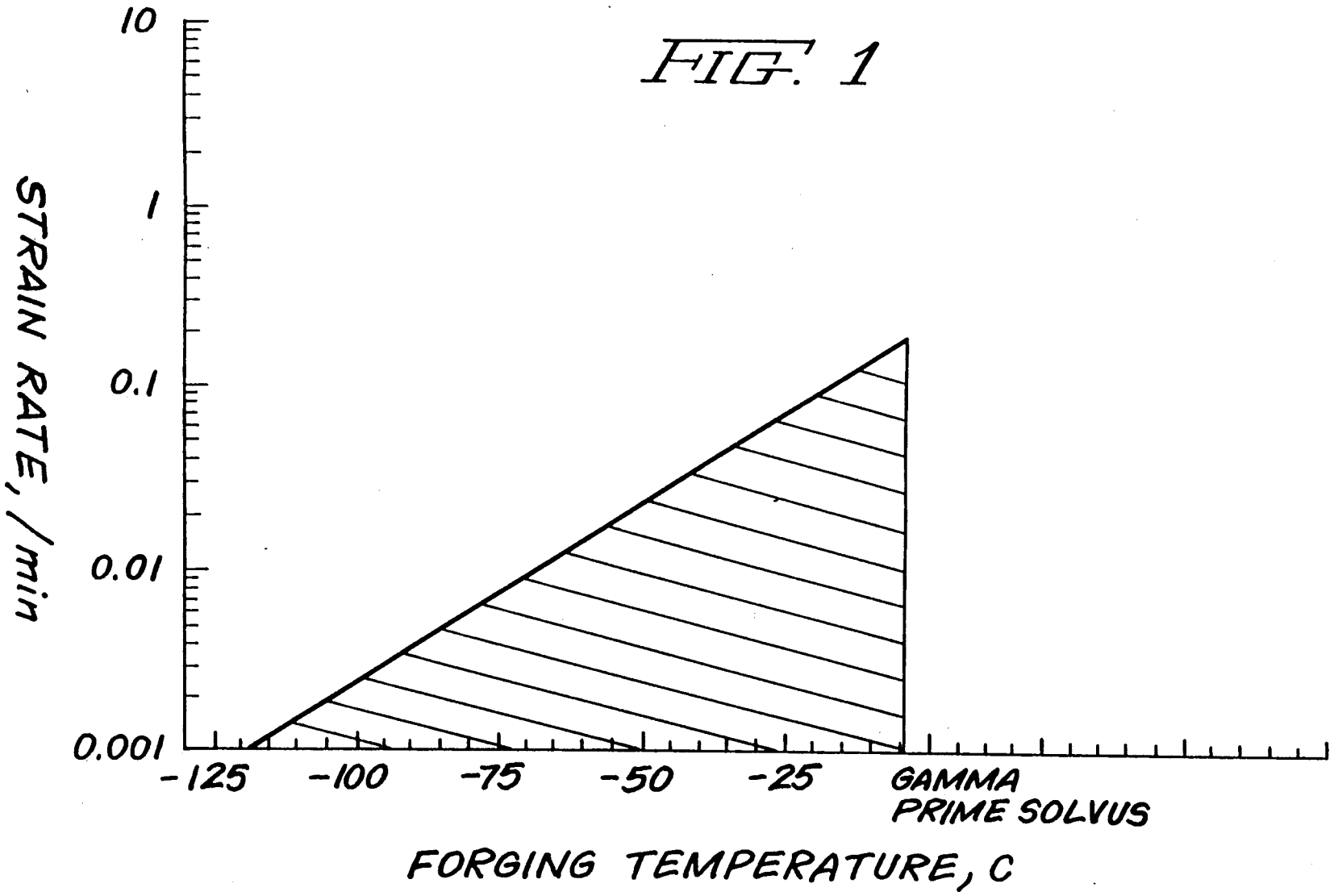
FIG. 1. is a graph showing isothermal forging conditions of strain rate and temperature.

A charge of a superalloy composition that forms a volume fraction of gamma prime greater than about 35 per cent is melted and spray-formed into an alloyed powder. The alloyed powder is confined and consolidated to form a compact approaching 100 percent theoretical density. The compact is isothermally forged at a temperature and at a rate of straining within the hatched area of FIG. 1 to produce a permanent deformation of at least about 20 percent in the compact. FIG. 1 is a graph showing forging conditions of strain rate, as plotted on the ordinate, and temperature, as plotted on the abscissa.

Isothermal forging within the strain rates and temperatures shown by the hatched area in FIG. 1 maintains a fine grain size of about 10 microns or less so that the alloy is forged in a superplastic state that allows deformation of the compact at a low flow strength. However, sufficient deformation energy from forging is retained within the grains so that when the alloy is subsequently annealed above the solvus temperature, the grains can grow to the growth grain structure of about 50 to 60 microns.

The annealed compact is then slowly cooled so that gamma prime is precipitated around the grain boundaries, and interacts with the grain boundaries to form irregular or serrated grain boundaries. In general, most superalloy compositions can be cooled at about 125.C per minute or less to form the serrated grain boundaries However, for some superalloy compositions having a low thermodynamic driving force for gamma prime formation the cooling rate will be less than 125° C. per minute. A subsequent aging treatment between about 650° to 850° C. for 8 to 64 hours is employed for precipitation strengthening of the alloy. Preferably aging is at about 760° C. for 16 hours to provide good strengthening while minimizing annealing time.

DETAILED DESCRIPTION OF THE INVENTION

The method of this invention provides improvement in fatigue crack propagation for superalloys formed by powder metallurgy techniques, and which have a relatively high volume concentration of gamma prime precipitate. More specifically, the method of this invention applies to superalloys having a volume fraction of gamma prime of at least 35 percent. For significant results the fraction of gamma prime should be at least 45 percent. Though not meant to be inclusive, compositions representative of the superalloys having a volume fraction of gamma prime greater than 35 percent are shown below in Table 1.

TABLE 1

Alloys Having Volume Fraction Of Gamma Prime Greater Than 35% Composition In Weight Percent

| | Astroloy | Rene95 | Unitemp AF2-1DA | IN100 | CH99 |
|---|---|---|---|---|---|
| Ni | Bal. | Bal. | Bal. | Bal. | Bal. |
| Cr | 15 | 13 | 12 | 10 | 11 |
| Co | 17 | 8 | 10 | 15 | 18 |
| Mo | 5.25 | 3.5 | 2.75 | 3 | 2.5 |
| W | | 3.5 | 6.5 | | 5.5 |
| Nb | | 3.5 | 4.6 | 5.5 | 3.75 |
| Ta | | | 1.5 | | 3.0 |
| Al | 4 | 3.5 | 4.6 | 5.5 | 3.75 |
| Ti | 3.5 | 2.5 | 2.8 | 4.7 | 3.75 |
| C | 0.06 | 0.06 | 0.04 | 0.05 | 0.05 |
| B | 0.03 | 0.01 | 0.02 | 0.014 | 0.02 |
| Zr | | 0.05 | | 0.06 | 0.05 |
| V | | | | 0.09 | |

An alloyed powder of a superalloy having a volume fraction of gamma prime of at least 35 percent is produced by any of the well-known powder forming techniques such as gas atomizing. A charge of the superalloy composition is melted under an inert atmosphere and the melt is atomized by impingement of an inert gas jet such as argon, against a stream of molten metal. The stream is atomized by this action and upon rapid cooling to the solid state the desired pre-alloyed powder is produced. The powder is screened to remove undesirably large particles.

The superalloy powder is confined and densified at elevated temperatures so as to form a compact approaching 100 percent theoretical density. The densification of the metallic powder can be achieved by any of the variety of techniques well known in the art including; extrusion, hot upsetting, vacuum die depressing, hot isostatic pressing, and explosive compaction. Densification is preferably performed by preheating the powder to an elevated temperature, to facilitate bonding of the powder particles, compaction, and deformation into a compact approaching 100 percent theoretical density. For most nickel-based superalloys, preheat temperatures ranging from 1100° C. up to about 1200° C. can be satisfactorily employed. The specific temperature used within the aforementioned range is dictated by that temperature approaching the solidus or just below the incipient melting point of the powder particles.

The aforementioned explosive compaction technique can be performed without any appreciable preheat. In the extrusion and hot upsetting compaction techniques it is conventional to confine the powder within a suitable container which is evacuated and subsequently sealed. Optimum packing of the interior of such containers with the loose powder can be achieved by subjecting the containers to sonic or supersonic frequencies wherein packing densities ranging from about 60 percent to about 70 percent of a theoretical 100 percent density can be obtained. It is also contemplated that the loose powder particles can be combined in the cavity of a die subjected to vacuum and compacted so as to make a perform approaching 85 percent to 90 percent theoretical density. Such a perform can also be obtained by compacting the powder in vacuum and sintering at an elevated temperature, forming a self-sustaining compact which subsequently can be subjected to further compaction to obtain substantially 100 percent density.

The powder compact has a fine grain size of 10 microns or less and can be superplastically formed. Superplastic forming in superalloys is a forming condition in which extremely high ductility is obtained at low flow strengths in a fine grained structure. The compact is isothermally forged in a superplastic state to a permanent deformation of at least about 20 per cent. However, the isothermal forging conditions are further limited so that the temperature, and the rate of straining are within the hatched area of FIG. 1. I have discovered that by isothermally forging within the rate of straining and temperatures shown by the hatched area of FIG. 1, a desired growth grain microstructure of 50 to 60 microns is obtained when the forged compact is subsequently supersolvus annealed.

The forged compact is supersolvus annealed as described above and slowly cooled. The annealed compact is slowly cooled so that gamma prime is precipitated around the grain boundaries, and interacts with the grain boundaries to form irregular or serrated grain boundaries. Superalloy compositions having a low thermodynamic driving force for gamma prime formation will form gamma prime more slowly and require slower cooling rates than the superalloys having high thermodynamic driving force for gamma prime formation.

In general, most superalloy compositions can be slow cooled at about 125° C. or less to form gamma prime around the grain boundaries so that the gamma prime interacts with the grain boundaries to form the serrated grain boundaries. However, the superalloy compositions having a low thermodynamic driving force for gamma prime formation are cooled at less than 125° C.

per minute, and superalloy compositions having a high thermodynamic driving force for gamma prime formation can be cooled at more than 125° C. per minute. Some of the composition's in Table I were investigated to determine cooling rates that form a serrated grain boundary for that composition. Acceptable cooling rates were found at 66° C. per minute for Rene 95, 42° C. per minute for Astroloy, 40° C. per minute for CH99, and 47° C. per minute for IN100. Unacceptable cooling rates that did not form serrated grain boundaries were found at 204.C per minute for Rene 95, 75.C per minute for CH99, and 750.C per minute for Astroloy.

Acceptable cooling rates for forming a serrated grain boundary can be determined for specific superalloy compositions by supersolvus annealing samples of the composition and slow cooling the samples at various rates. After slow cooling the samples are examined metallographically to determine at which cooling rates a serrated grain boundary was formed.

After slow cooling a subsequent aging treatment between about 650° to 850° C. for 8 to 64 hours is employed for precipitation strengthening of the alloy.

The thermomechanical processes disclosed herein and the improved resistance to time-dependant fatigue crack propagation are further shown in the following examples.

EXAMPLE 1

An alloy sample having the composition of Rene 95, as shown in Table I above, was obtained to demonstrate the temperature sensitivity of the time-dependence of fatigue crack propagation. The alloy sample was prepared by powder metallurgy techniques and heat treated by the method of the '084 patent to improve resistance to fatigue crack propagation at temperatures up to 650° C as shown in the '084 patent. Test samples. for fatigue and stress-rupture testing were machined from the processed Rene 95 sample. Rene 95 is known to be the strongest of the nickel based superalloys which is commercially available.

Three fatigue tests were performed on the Rene 95 test samples with the first two tests at 650° C and the third test at 760° C. Cyclic stress was applied in the first test in three second cycles, and the second and third tests were performed with a three second cycle which was interrupted by a 90 second hold at the maximum stress. These cyclic tests are similar to those employed in the NASA study discussed above. The ratio of the minimum load to the maximum load was set at 0.05 in Examples 1 and the following Examples 2 and 3 so that the maximum load was twenty times greater than the minimum load. The results of the fatigue testing in Example 1 are plotted in FIG. 2.

Figure 2:
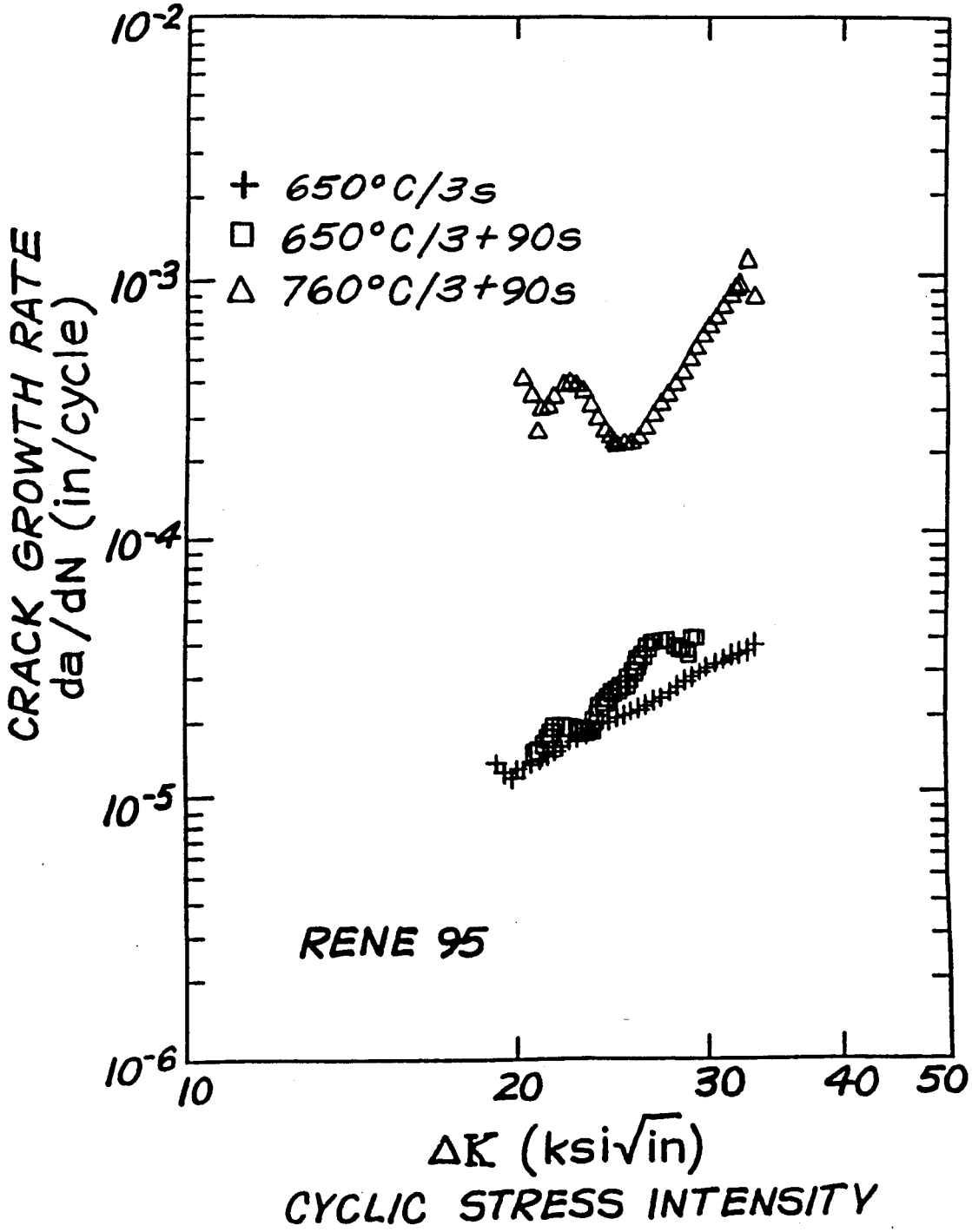
FIGS. 2–8 are graphs showing fatigue crack growth rates at 650° or 760° C. obtained by the application of different stress intensities at different frequencies with some of the cyclic stress applications including a hold time at maximum stress intensity.

FIG. 2 shows that the crack growth rate of Rene 95 annealed by the method of the '084 patent is substantially time-independent at the 650° C. test temperature, however, at the 760° C. test temperature the crack growth rate has become time-dependent increasing by about an order of magnitude. This example demonstrates the temperature sensitivity of the time-dependence of the fatigue crack propagation rate which is magnified at 760° C in Rene 95 processed by the method of the '084 patent.

EXAMPLE 2

Example 2 shows that forging temperature and strain rates can influence the microstructure of a powdered superalloy composition even after it is supersolvus annealed. The Rene 95 composition in Table 1 was prepared by vacuum induction melting and the molten composition was atomized into powders by argon spraying. The precipitate solvus temperature of Rene 95 was determined by a metallographic technique as described above to be about 1155° C. to about 1160° C. The powders were collected into stainless steel cans and consolidated into compacts by hot isostatic pressing at about 1100° C., and 15 ksi pressure for 4 hours.

Cylindrical forging coupons of 0.40 inch diameter by 0.60 inch length were prepared from the compacts, and isothermally forged at various constant strain rates using a hydraulic press. Each coupon was deformed in compression by a 60 percent reduction in height. The as-forged coupons were then supersolvus annealed at 1175° C. for 1 hour. Samples of the coupons were taken before and after supersolvus solutioning and metallographically examined to determine the grain structures.

Metallographic examination of the as-forged samples showed that forging at temperatures above the precipitate solvus produced well recrystalized coarse grains having a grain size greater than 20 microns. When the forging temperature was maintained below the precipitate solvus a fine grain size less than 10 microns was found. When the forging temperature was near the precipitate solvus and the strain rate was high, a mixed grain structure comprised of both coarse and fine grains was observed. To maintain a superplastic forming state, a fine grain size less than 10 microns is desired during forging.

After supersolvus annealing, the grain structure of the samples was again metallographically examined. Samples having coarse grains or mixed grain structures after forging developed a coarser grain size averaging greater than 60 microns after supersolvus annealing. Surprisingly, however, samples which had maintained a fine grain size after forging were found in some instances to have a growth grain structure of 50 to 60 microns and in other instances to maintain a standard grain size of about 20 microns after the supersolvus anneal.

Samples which had formed the growth grain structure of 50 to 60 microns after supersolvus annealing were found to be within certain critical ranges of strain rate and temperature during forging. The critical ranges of strain rate and forging temperature that maintain a fine grain structure of about 10 microns or less during isothermal 0 forging, but develop a growth grain structure of about 50 to 60 microns after supersolvus annealing are shown as the hatched area in FIG. 1.

EXAMPLE 3

The composition for CH99 in Table I was prepared by vacuum induction melting and the molten composition was atomized into powders. Two powder compacts were formed by placing the powder in two separate stainless steel cans that were hot isostatically pressed at a temperature of 1125° C. and pressure of 15 ksi for four hours. The solvus temperature of the composition was determined by metallographic examination as described above to be 1185° to 1190° C. The compacts were thermomechanically processed by various combinations of isothermal forging, supersolvus annealing, and slow cooling conditions. Specific forging, annealing, and slow cooling conditions used on each compact are shown in Table II below. Each compact was forged at a strain rate of 0.075 per minute. It was found in this experiment that alloy CH99 requires a slow cooling rate of about 60.C per minute or less to precipitate sufficient gamma prime at the grain boundaries to form a serrated grain boundary.

After forging the compacts were cut into specimen blanks and annealed. Annealed specimen blanks were then machined into test samples for tensile and fatigue testing. Some test samples were used to test the elevated temperature yield strength in conformance with ASTM specification E8 ("Standard Methods of Tension Testing of Metallic Materials", Annual Book of ASTM Standards, Vol. 03.01, pp. 130–150, 1984). Table II also contains the yield strength at 650° C. for alloys of this invention processed according to the conditions shown in Table II.

TABLE II

| Thermomechanical Processing of Samples Prepared in Example 2 | | | | | | |
|---|---|---|---|---|---|---|
| Process No. | Isothermal Forging Temp. (°C.) | One Hour Supersolvus Anneal (°C.) | Cooling Rate (°C./Min.) | 16 Hour Age Harden Anneal (°C.) | Final Grain Size (Microns) | Strength (650° C.) |
| 1 | 1125 | 1200 | 75 | 760 | 20–30 | 156.1 |
| 2 | 1175 | 1200 | 75 | 760 | 50–60 | 149 |
| 3 | 1175 | 1200 | 40 | 760 | 50–60 | 140.8 |
| 4 | 1125 | 1200 | 40 | 760 | 20–30 | 150.3 |

Of the four different processes shown in Table II only process 3 is within each of the thermomechanical process treatments disclosed herein as isothermal forging within the conditions shown as the hatched area in FIG. 1, supersolvus annealing, and slow cooling to provide serrated grain boundaries.

Figure 3:
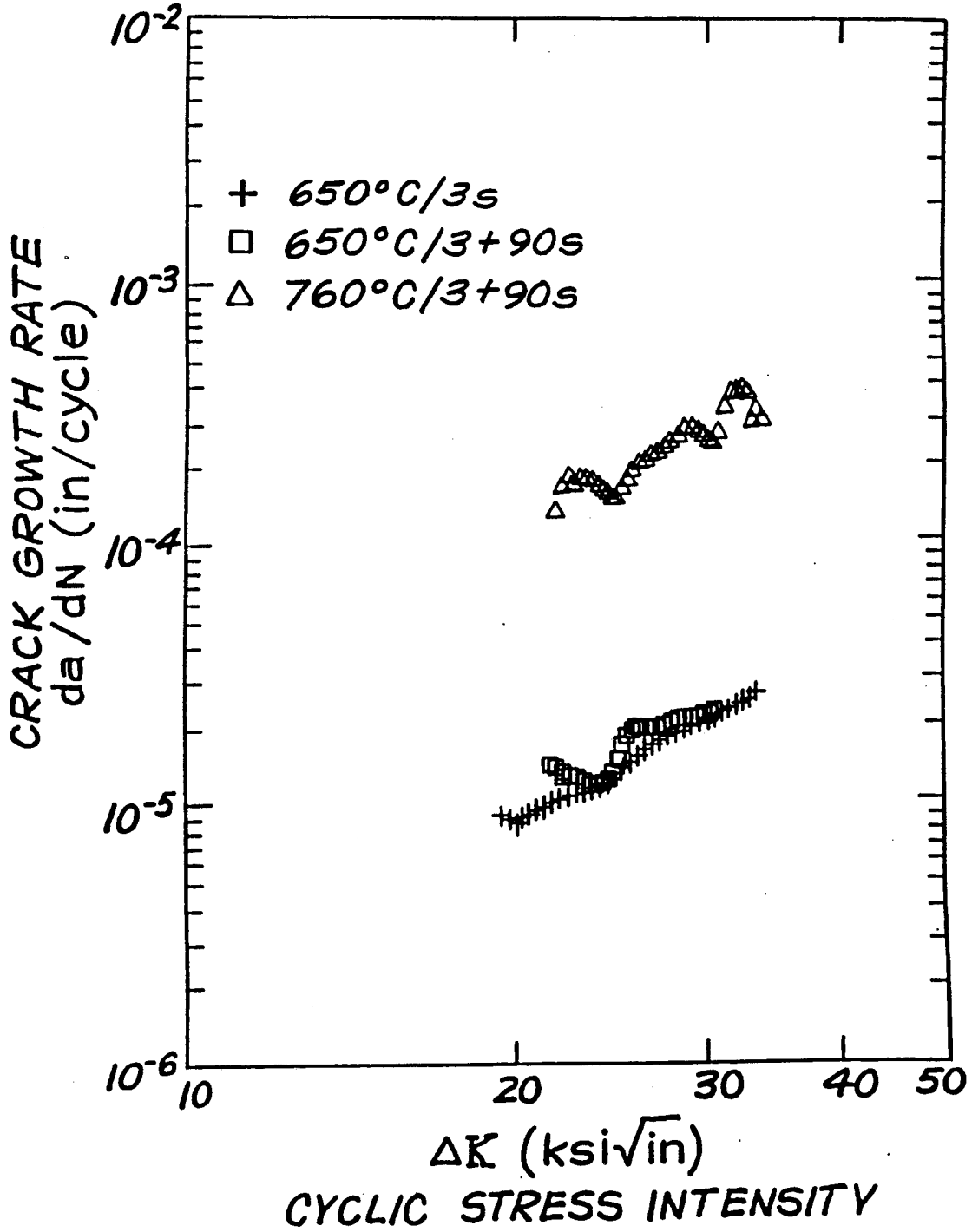

The same cyclic testing at 650° C. and 760° C. performed in Example 1 was performed on the test samples prepared in Example 3. Results of the cyclic stress testing of test samples prepared by processes 1,2,3, and 4 are shown in FIGS. 3–6. In FIG. 3, the test samples prepared according to process 1 show a return to time-dependent fatigue crack propagation rates when the test temperature is increased from 650° C. to 760° C. Test samples treated by process 1 had a combination of forging temperature and strain rate outside the hatched area in FIG. 1, and were cooled after supersolvus annealing at a rate about 15° C. above the 60° C./min. maximum cooling rate for CH99. After annealing the samples exhibited a grain size of 20 to 30 microns, less than the desired growth grain size of 50 to 60 microns.

Figure 4:
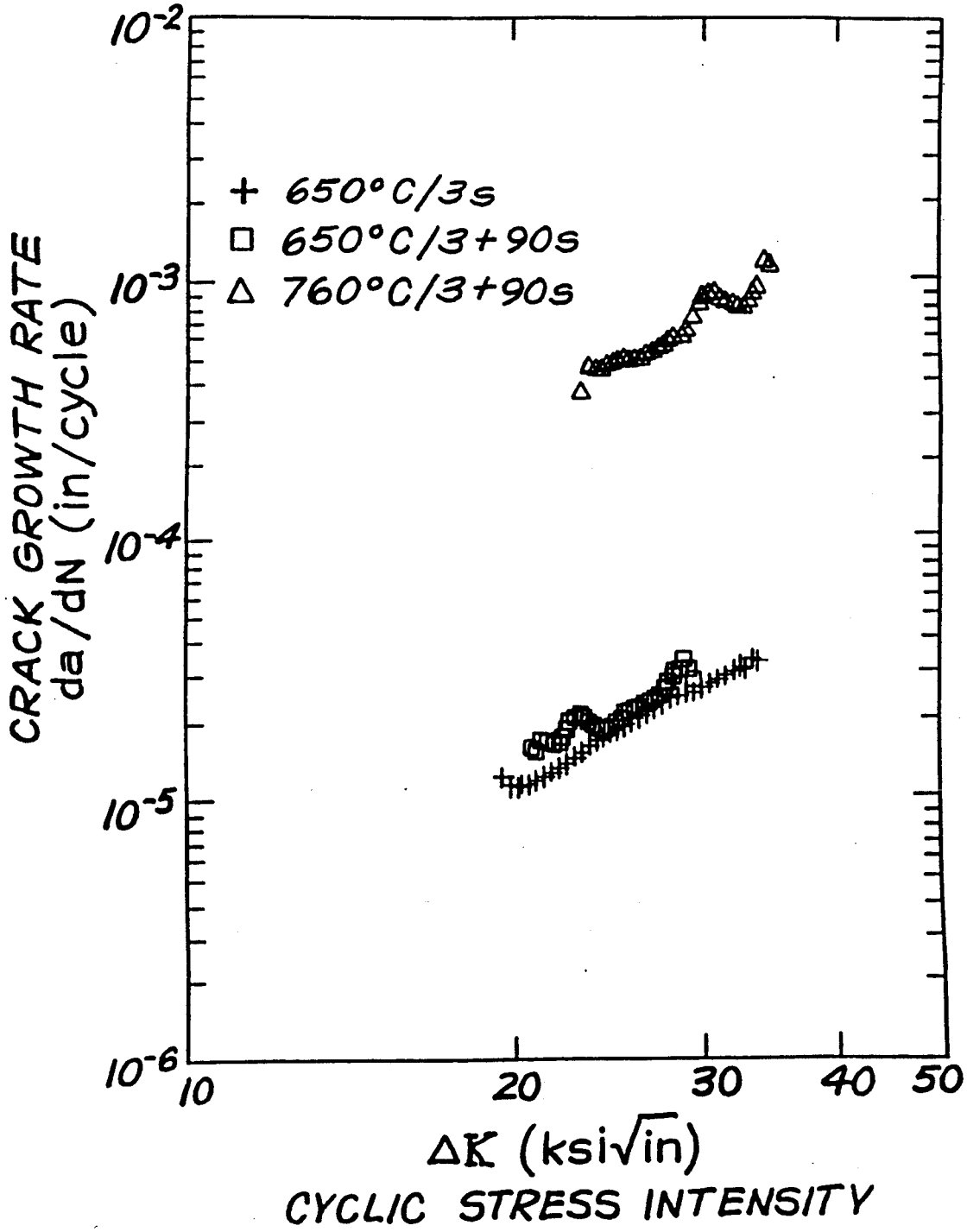

FIG. 4 shows the test samples prepared according to process 2 have a return to time-dependent fatigue crack propagation rates when testing temperature is increased from 650° C. to 760° C. Test samples treated by process 2 had a combination of forging temperature and strain rate within the hatched area of FIG. 1 and exhibited the desired growth grain size of 50–60 microns, but were cooled after supersolvus annealing at a rate about 15° C. above the 60° C. per minute maximum cooling rate for CH99.

Figure 5:
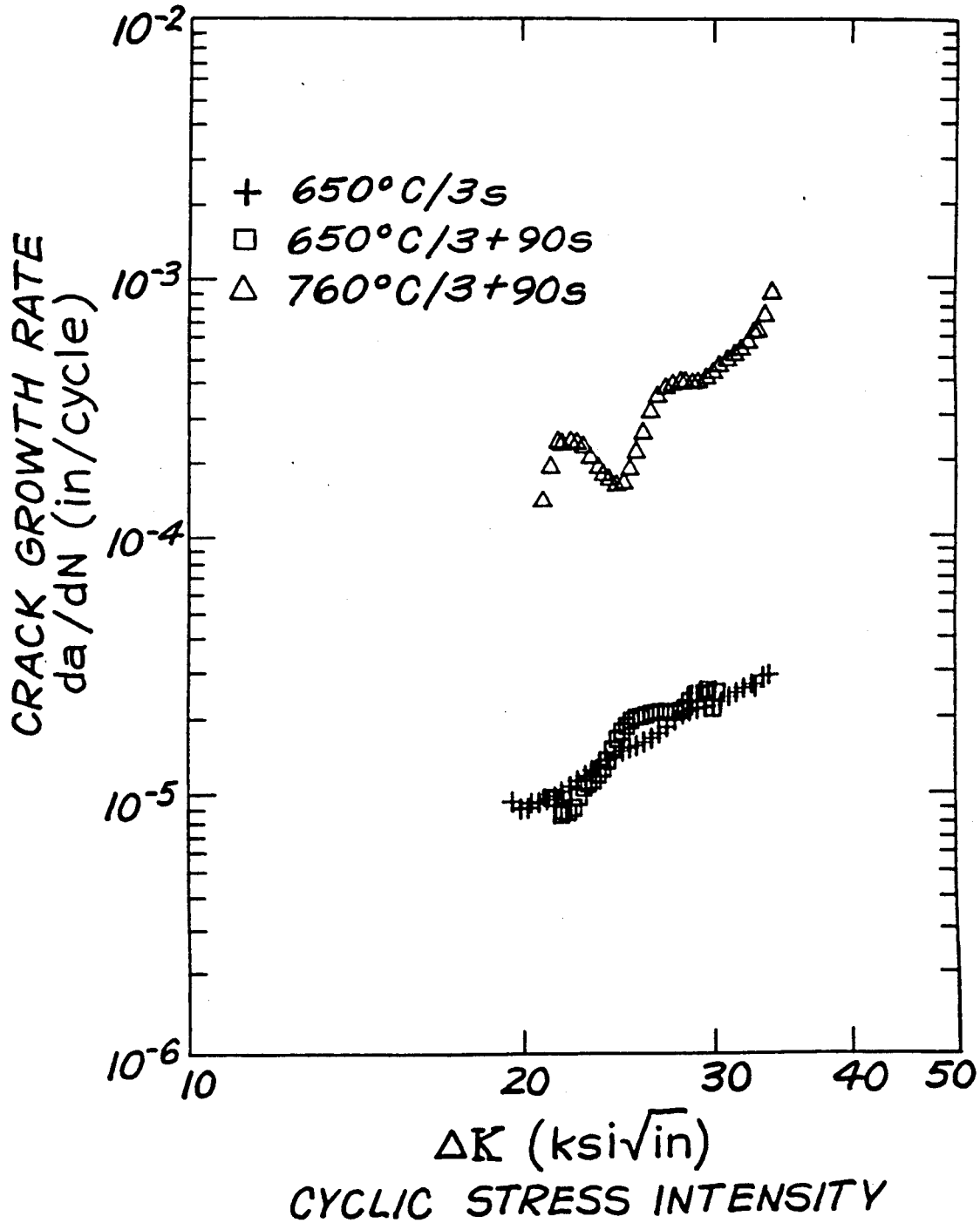

FIG. 5 shows the test samples prepared according to process 4 exhibit a return to time-dependent fatigue crack propagation rates when the test temperature is increased from 650° C. to 760° C. Test samples treated by process 4 had a cooling rate below the 60° C per minute maximum cooling rate for CH99, but had a combination of forging temperature and strain rate outside the hatched area in FIG. 1. After annealing the samples exhibited a grain size of 20 to 30 microns, less than the desired growth grain size of 50 to 60 microns.

Figure 6:
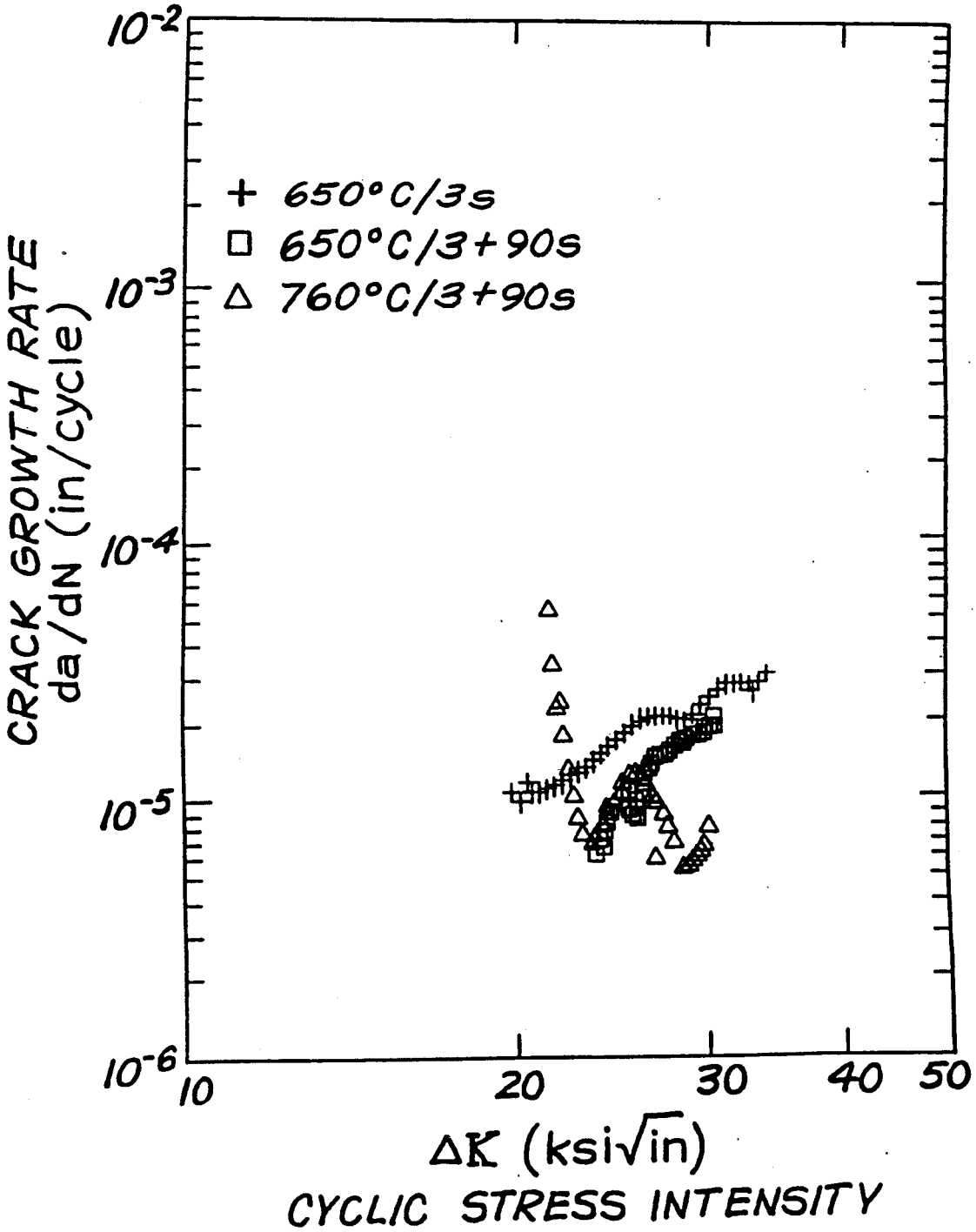

FIG. 6 shows that the test samples prepared according to process 3 exhibit a substantially time-independent fatigue crack propagation rate when the testing temperature is increased from 650° C. to 760° C. Test samples treated by process 3 had a combination of forging temperature and strain rate within the hatched area of FIG. 1, exhibited the desired growth grain size of 50-60 microns, and were cooled after supersolvus annealing at a rate below the 60° C. per minute maximum cooling rate for CH99. For superalloy compositions processed according to the method of this invention as described above, a time-independent fatigue crack propagation rate is found at temperatures up to 760° C.

EXAMPLE 4

The composition for AF2-lDA in Table I was prepared by vacuum induction melting and the molten composition was atomized into powders by argon spraying. The precipitate solvus temperature was determined by the metallographic technique described above and was found to be 1180° C. to 1185° C. Two cans of powders were consolidated into compacts by hot isostatic pressing at about 1125° C., and 15 ksi pressure for 4 hours. One of the compacts was isothermally forged at a combination of strain rate and temperature that was outside the hatched area of FIG. 1 and the second compact was isothermally forged with a combination of strain rate and temperature that was within the hatched area of FIG. 1. The forged compacts were then supersolvus annealed for 1 hour at 1190° C and slow cooled. The metal processing conditions for each compact are given in Table III below. A subsequent aging treatment at 760° C. for 16 hours was employed to harden the alloy.

TABLE III

| Thermomechanical Processing Conditions for Test Samples In Example 3 | | | | | | |
|---|---|---|---|---|---|---|
| Alloy | Process No. | Isothermal Strain Rate (1/Min) | Forging Temp. (°C.) | Supersolvus Anneal (°C.) | Cooling Rate (°C./Min) | Final Grain Size (Micron) |
| AF2-lDA | 1 | 0.075 | 1125 | 1190 | 75 | 20–30 |
| AF2-lDA | 2 | 0.075 | 1175 | 1190 | 75 | 50–60 |

Test samples machined from the processed compacts were heated to 760° C. and the fatigue crack growth rate was measured. Three tests were performed on test samples processed according to process number 2 in Table III, and a different cyclic application of stress to the sample was used in each of the three tests. Cyclic stress was applied to one sample in 3 second cycles. In the second sample, the cyclic wave form was a 100 second cycle, and the third sample had stress applied in a three second cycle which was interrupted by a 177 second hold at the maximum stress. The cyclic tests are similar to those employed in the NASA study. The results of the testing are plotted in FIG. 7.

Figure 8:
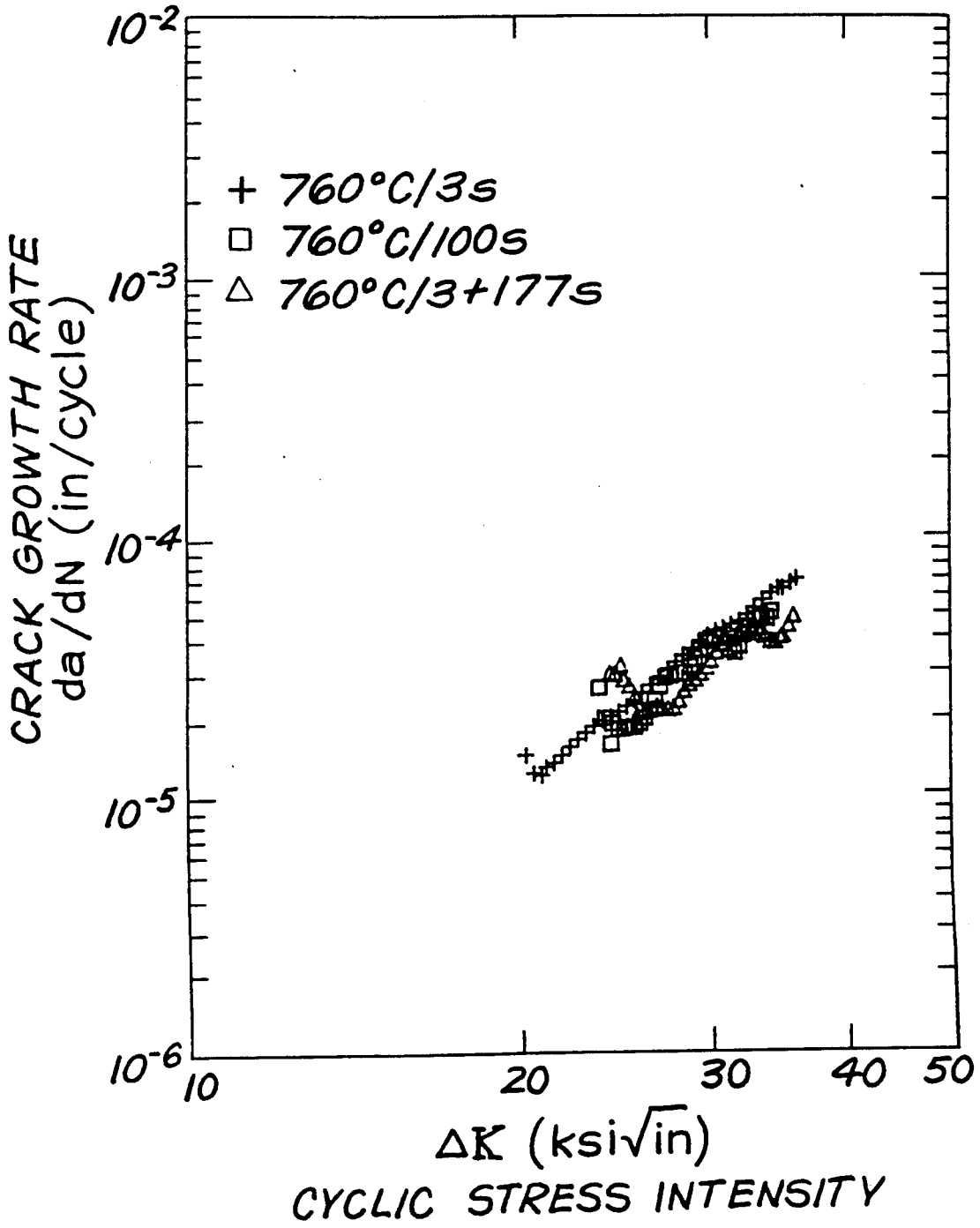

Test samples processed according to process number 1 in Table III were tested by the same cyclic testing at 650° C. and 760° C. performed in Example 1, and the results of the testing are plotted in FIG. 8.

Figure 7:
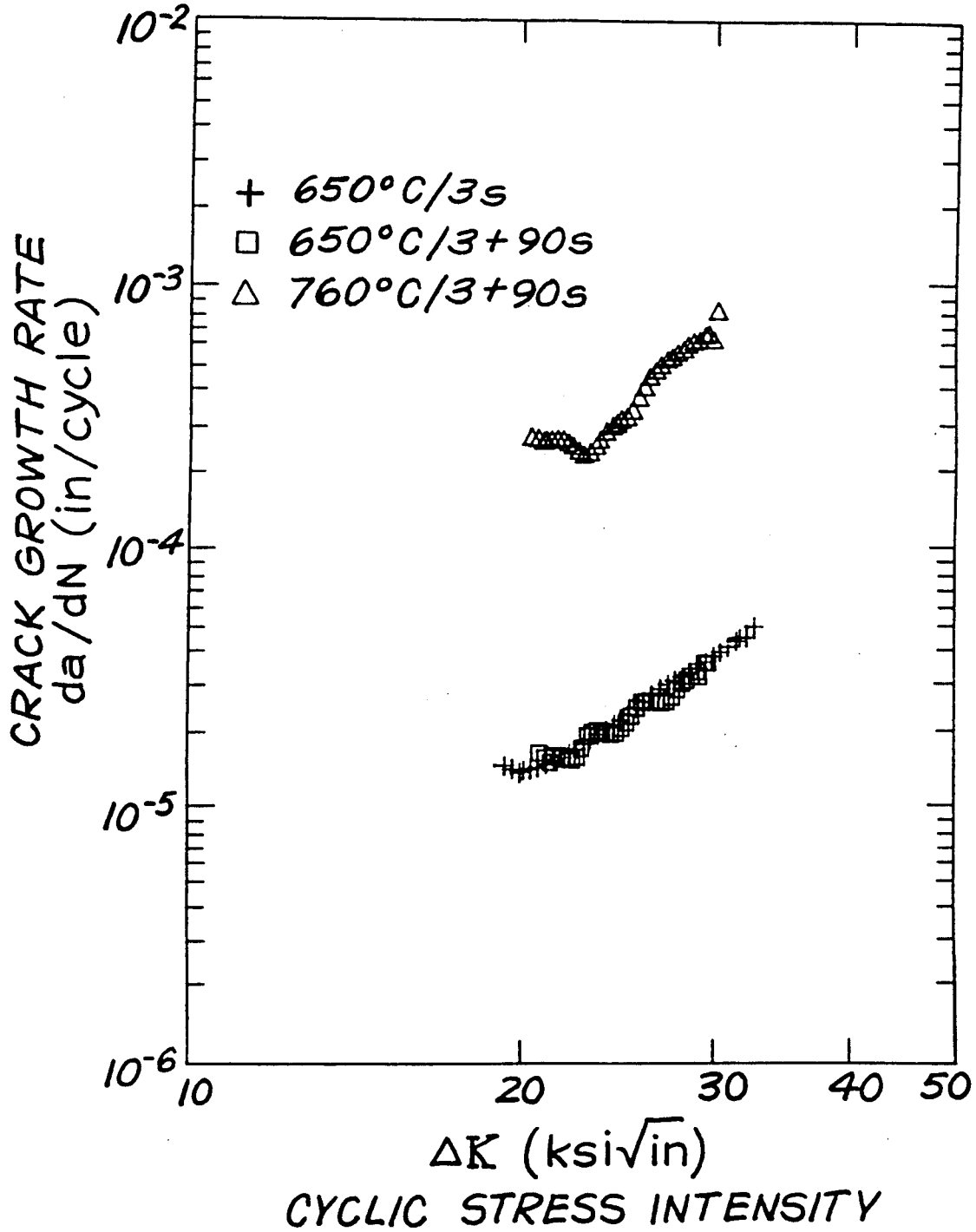

FIG. 7 shows the test samples prepared according to process 1 exhibit a return to time-dependent fatigue crack propagation rates when the test temperature is increased from 650° C. to 760° C. Test samples treated by process 1 had a combination of forging temperature and strain rate outside the hatched area in FIG. 1. After annealing the samples exhibited a grain size of 20 to 30 microns, less than the desired growth grain size of 50 to 60 microns.

FIG. 8 shows that the test samples prepared according to process 2 exhibit a substantially time-independent fatigue crack propagation rate at a test temperature of 760° C. Test samples treated by process 2 had a combination of forging temperature and strain rate within the hatched area of FIG. 1, exhibited the desired growth grain size of 50-60 microns, and were cooled after supersolvus annealing at a slow rate providing serrated grain boundaries. For superalloy compositions processed according to the method of this invention as described above, a time-independent fatigue crack propagation rate is found at temperatures up to 760° C.

We claim:

1. A method for improving resistance to fatigue cracking articles manufactured from a nickel base superalloy powder compact, the superalloy having a volume fraction of gamma prime precipitate of at least about 35 per cent, comprising:

determining the solvus temperature of the gamma prime precipitate as the temperature at which the gamma prime predipitate essentially dissolves in the superalloy matrix;

isothermally forging the compact at a rate of straining and at a temperature within the hatched area in FIG. 1, to produce a permanent deformation of at least about 20 percent;

supersolvus annealing the forged superalloy for a period of time that essentially completely dissolves the gamma prime precipitate; and slowly cooling the alloy from the supersolvus temperature, the compact having an equiaxed grain structure of about 50 to 60 microns.

2. The method of claim 1 additionally comprising the step of aging the alloy at about 650° to 850° C. for about to 64 hours.

3. The method of claim 1 wherein the alloy is cooled at a rate of about 125° C. per minute or less.

4. The method of claim 1 wherein the alloy is supersolvus annealed between about 5° to 35° C. above the solvus temperature.

5. The method of claim 1 wherein the alloy is supersolvus annealed for at least about one hour.

6. A method for improving the resistance to fatigue cracking in articles manufactured from a compact of nickel based superalloy powders having a nickel base superalloy matrix and a volume fraction of gamma prime precipitate of at least about 35 per cent, comprising:

determining the solvus temperature of the gamma prime precipitate as the temperature at which the gamma prime precipitate essentially dissolves in the superalloy matrix;

isothermally forging the compact at a temperature about 5° to 125° C. below the solvus temperature and at a strain rate that maintains a fine grain size up to about 10 microns during forging but causes grain growth to about 50 to 60 microns during subsequent supersolvus annealing;

supersolvus annealing the forged superalloy for a period of time that essentially completely dissolves the gamma prime precipitate; and slowly cooling the alloy from the supersolvus temperature, the compact having an equiaxed grain structure of about 50 to 60 microns.

7. The method of claim 6 additionally comprising the step of aging the alloy at about 650° to 850° for about 8 to 64 hours.

8. The method of claim 6 wherein the alloy is cooled at a rate of about 125° per minute or less.

9. The method of claim 6 wherein the alloy is supersolvus annealed between about 5° to 35° C. above the solvus temperature.

10. The method of claim 6 wherein the alloy is supersolvus annealed for at least about one hour.

* * * * *